US010240613B2

(12) United States Patent
Lardy et al.

(10) Patent No.: US 10,240,613 B2
(45) Date of Patent: Mar. 26, 2019

(54) SUPERSONIC COMPRESSOR WITH STRUCTURAL ARRANGEMENT TO INCREASE PRESSURE ENERGY IN A DISCHARGE PROCESS FLUID RECEIVED FROM A CENTRIFUGAL IMPELLER

(71) Applicants: Pascal Lardy, Houston, TX (US); James M. Sorokes, Olean, NY (US); Mark J. Kuzdzal, Allegany, NY (US)

(72) Inventors: Pascal Lardy, Houston, TX (US); James M. Sorokes, Olean, NY (US); Mark J. Kuzdzal, Allegany, NY (US)

(73) Assignee: DRESSER-RAND COMPANY, Olean, NY (US)

( * ) Notice: Subject to any disclaimer, the term of this patent is extended or adjusted under 35 U.S.C. 154(b) by 994 days.

(21) Appl. No.: 14/272,667

(22) Filed: May 8, 2014

(65) Prior Publication Data

US 2014/0341706 A1 Nov. 20, 2014

Related U.S. Application Data

(60) Provisional application No. 61/823,237, filed on May 14, 2013.

(51) Int. Cl.

| | |
|---|---|
| ***F04D 29/44*** | (2006.01) |
| ***F04D 29/46*** | (2006.01) |
| ***F04D 17/10*** | (2006.01) |
| ***F04D 21/00*** | (2006.01) |
| ***F04D 29/42*** | (2006.01) |
| ***F04D 25/06*** | (2006.01) |

(52) U.S. Cl.

CPC ..... *F04D 29/444* (2013.01); *F04D 17/10* (2013.01); *F04D 21/00* (2013.01); *F04D 25/0686* (2013.01); *F04D 29/422* (2013.01); *F04D 29/462* (2013.01); *F05D 2240/121* (2013.01); *F05D 2250/52* (2013.01)

(58) Field of Classification Search

CPC ..... F04D 17/10; F04D 21/00; F04D 25/0686; F04D 29/422; F04D 29/444; F04D 29/462; F04D 17/12; F05D 2240/121; F05D 2250/52

USPC ..... 415/143, 149.1, 181, 208.2

See application file for complete search history.

(56) References Cited

U.S. PATENT DOCUMENTS

| | | | | |
|---|---|---|---|---|
| 3,904,308 A * | 9/1975 | Ribaud | F04D 21/00 | 415/143 |
| 7,581,925 B2 * | 9/2009 | Xu | F04D 29/444 | 415/208.2 |
| 2012/0107106 A1 * | 5/2012 | Hofer | F04D 17/12 | 415/181 |

* cited by examiner

*Primary Examiner* — Mark Laurenzi
*Assistant Examiner* — Paul Thiede

(57) ABSTRACT

A supersonic compressor provided may include an axial inlet and a centrifugal impeller fluidly coupled to the axial inlet. The centrifugal impeller may have a periphery and may be configured to impart energy to process fluid received via the axial inlet and discharge the process fluid from the periphery in at least a partially radial direction. The supersonic compressor may further include a static diffuser circumferentially disposed about the periphery of the centrifugal impeller and configured to receive the process fluid from the centrifugal impeller and convert the energy imparted. The static diffuser may include a plurality of diffuser vanes defining diffuser passageways therebetween. A supersonic ramp may be formed at an end of the at least one diffuser vane proximate the periphery of the centrifugal impeller. The supersonic ramp may be configured to generate a shock wave from the process fluid.

18 Claims, 5 Drawing Sheets

SUPERSONIC COMPRESSOR WITH STRUCTURAL ARRANGEMENT TO INCREASE PRESSURE ENERGY IN A DISCHARGE PROCESS FLUID RECEIVED FROM A CENTRIFUGAL IMPELLER

CROSS-REFERENCE TO RELATED APPLICATIONS

This application claims priority to U.S. Provisional Patent Application having Ser. No. 61/823,237, which was filed May 14, 2013. This priority application is hereby incorporated by reference in its entirety into the present application to the extent consistent with the present application.

BACKGROUND

Reliable and efficient compressors and systems including compressors have been developed and are utilized in a myriad of industrial processes (e.g., petroleum refineries, offshore oil production platforms, and subsea process control systems). Generally, conventional compressors are utilized to compress gas, typically by applying mechanical energy to the gas in a low pressure environment and transporting the gas to and compressing the gas within a high pressure environment, such that the compressed gas may be utilized to perform work or for operation of one or more downstream process components.

As conventional compressors are increasingly used in offshore oil production facilities and other environments facing space constraints, there is an ever-increasing demand for smaller, lighter, and more compact compressors. In addition to the foregoing, it is desirable for commercial purposes that the compact compressors achieve higher compression ratios (e.g., 10:1 or greater) while maintaining a compact arrangement.

In view of the foregoing, skilled artisans may often attempt to achieve the higher compression ratios by increasing the number of compression stages within the compact compressor. Increasing the number of compression stages, however, increases the overall number of components (e.g., impellers and/or other intricate parts) required to achieve the desired compressor throughput (e.g., mass flow) and pressure rise to achieve the higher compression ratios. Increasing the number of components required in these compact compressors may often increase length requirements for the rotary shaft and/or increase distance requirements between rotary shaft bearings. The imposition of these requirements often results in larger, less compact compressors as compared to compact compressors utilizing fewer compression stages. Further, in many cases, increasing the number of compression stages in the compact compressors may still not provide the desired higher compression ratios or, if the desired compression ratios are achieved, the compact compressors may exhibit decreased efficiencies that make the compact compressors commercially undesirable.

At least one known proposed solution to the above-mentioned constraints of conventional compact compressors has been the utilization of supersonic compressors to achieve higher compression ratios while maintaining a compact structure. At least some of the known supersonic compressors utilize a supersonic compressor rotor to achieve greater single-stage pressure ratios than conventional compressors. In doing so, at least some of the known supersonic compressors discharge gas from a flow channel formed therein in an axial direction, thereby requiring downstream components of the supersonic compressor rotor to be capable of receiving axial flow. Accordingly, an efficiency of compressing the gas may be limited to the efficiency of the axial-flow supersonic compressor rotor. Such a limitation may present challenges to the commercial viability of the supersonic compressor.

What is needed, then, is an efficient supersonic compression system and method thereof that provides increased compression ratios in a compact arrangement that is economically and commercially viable.

SUMMARY

Embodiments of the disclosure may provide a supersonic compressor. The supersonic compressor may include an axial inlet defining an inlet passageway configured to receive and flow a process fluid therethrough, and a rotary shaft configured to be driven by a driver. The supersonic compressor may also include a centrifugal impeller mounted about the rotary shaft and fluidly coupled to the axial inlet. The centrifugal impeller may have a periphery and may be configured to impart energy to the process fluid received via the axial inlet and discharge the process fluid from the periphery in at least a partially radial direction. The supersonic compressor may further include a static diffuser circumferentially disposed about the periphery of the centrifugal impeller and configured to receive the process fluid from the centrifugal impeller and convert the energy imparted. The static diffuser may include a plurality of diffuser vanes such that adjacent diffuser vanes of the plurality of diffuser vanes define a diffuser passageway therebetween. At least one of the diffuser vanes of the plurality of diffuser vanes may include a supersonic ramp formed at an end of the at least one diffuser vane proximate the periphery of the centrifugal impeller. The supersonic ramp may be configured to generate a shock wave from the process fluid.

Embodiments of the disclosure may further provide a supersonic compression system. The supersonic compression system may include a driver having a drive shaft. The drive shaft may be configured to provide the drive shaft with rotational energy. The supersonic compression system may also include a supersonic compressor operatively coupled to the driver via a rotary shaft integral with or coupled with the drive shaft. The supersonic compressor may include an axial inlet defining an inlet passageway configured to flow a process fluid therethrough having a first velocity and first pressure energy. The supersonic compressor may also include a centrifugal impeller mounted about the rotary shaft and fluidly coupled to the axial inlet. The centrifugal impeller may have a periphery and may be configured to increase the first velocity and first pressure energy of the process fluid received via the axial inlet and discharge the process fluid from the periphery in at least a partially radial direction having a second velocity and second pressure energy. The second velocity may be a supersonic velocity. The supersonic compressor may further include a static diffuser circumferentially disposed about the periphery of the centrifugal impeller and configured to receive and reduce the second velocity of the process fluid to a third velocity and increase the pressure energy of the second pressure energy to a third pressure energy. The third velocity may be a subsonic velocity. The static diffuser may include a plurality of diffuser vanes such that adjacent diffuser vanes of the plurality of diffuser vanes define a diffuser passageway therebetween. At least one of the diffuser vanes of the plurality of diffuser vanes may include a supersonic ramp formed at an end of the at least one diffuser vane proximate the periphery of the centrifugal impeller. The supersonic ramp may be configured to generate a shock wave from the process fluid. The supersonic compressor may also include a discharge volute fluidly coupled to the static diffuser and configured to receive the process fluid flowing therefrom.

Embodiments of the disclosure may further provide a method for compressing a process fluid. The method may include driving a rotary shaft of a supersonic compressor via a drive shaft operatively coupled with the supersonic compressor. The drive shaft may be driven by a driver. The method may also include providing the process fluid at a low pressure environment via an axial inlet of the supersonic compressor, and rotating a centrifugal impeller mounted about the rotary shaft, such that the process fluid provided via the axial inlet is drawn into the centrifugal impeller and discharged at a periphery of the centrifugal impeller having a supersonic velocity. The method may further include flowing the process fluid having a supersonic velocity across a supersonic ramp formed at an end of a diffuser vane disposed in a static diffuser fluidly coupled to the centrifugal compressor, such that a shock wave is produced and a pressure energy of the process fluid is increased, thereby compressing the process fluid.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
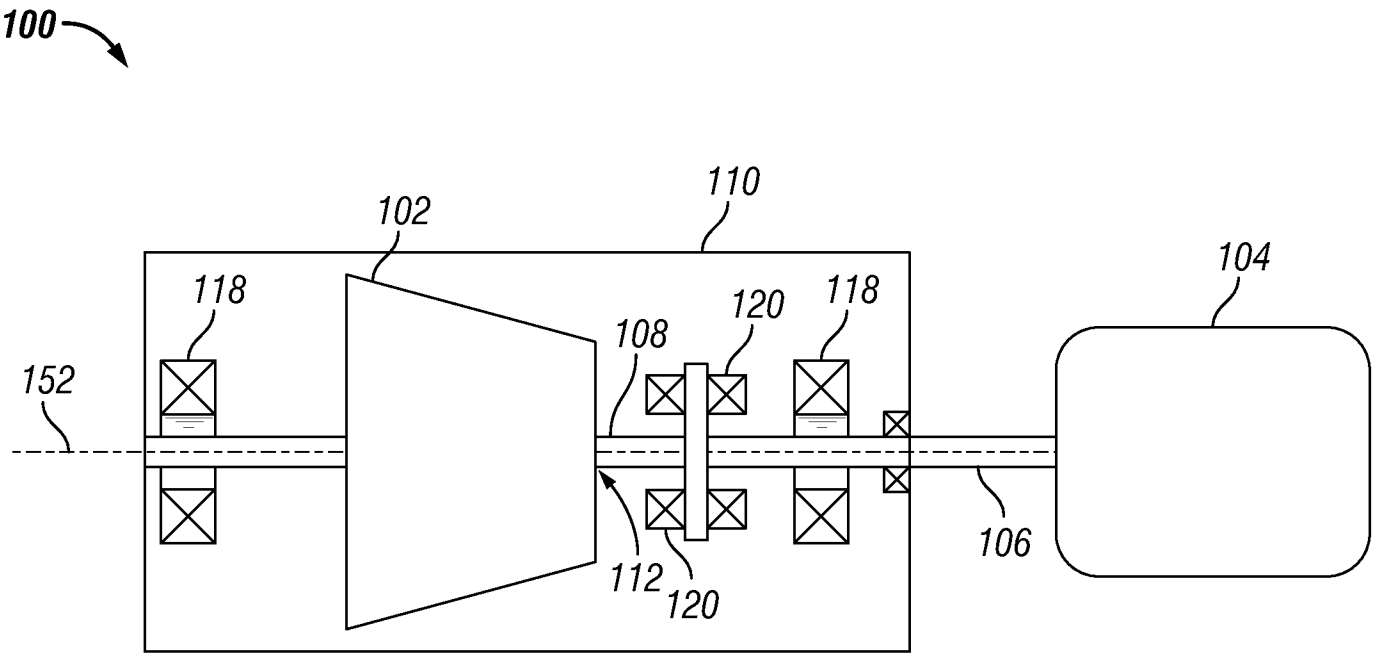
FIG. 1 illustrates a schematic view of an exemplary supersonic compression system including a supersonic compressor operatively coupled to a driver, according to one or more embodiments.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1 illustrates a schematic view of an exemplary supersonic compression system 100 including a supersonic compressor 102, according to one or more embodiments. The supersonic compression system 100 may be configured to pressurize a process fluid and may include, amongst other components, a driver 104 operative coupled to the supersonic compressor 102 via a drive shaft 106. The driver 104 may be configured to provide the drive shaft 106 with rotational energy. In an exemplary embodiment, the drive shaft may be integral with or coupled with a rotary shaft 108 of the supersonic compressor 102, such that the rotational energy of the drive shaft 106 is imparted to the rotary shaft 108. The drive shaft 106 of the driver 104 may be coupled with the rotary shaft 108 via a gearbox (not shown) including a plurality of gears configured to transmit the rotational energy of the drive shaft 106 to the rotary shaft 108 of the supersonic compressor 102, such that the drive shaft 106 and the rotary shaft 108 may spin at the same speed, substantially similar speeds, or disparate speeds.

The driver 104 may be a motor and more specifically may be an electric motor, such as a permanent magnet motor, and may include a stator (not shown) and a rotor (not shown). It may be appreciated, however, that other embodiments may employ other types of electric motors including, but not limited to, synchronous motors, induction motors, brushed DC motors, or the like. The driver 104 may also be a hydraulic motor, an internal combustion engine, a gas turbine, or any other device capable of driving the rotary shaft 108 of the supersonic compressor 102 either directly or through a power train.

In an exemplary embodiment, the supersonic compressor 102 may be a direct-inlet, centrifugal compressor. The direct-inlet, or axial-inlet, centrifugal compressor may be, for example, a Dresser-Rand PDI centrifugal compressor manufactured by the Dresser-Rand Company of Olean, N.Y. In an exemplary embodiment, the supersonic compressor 102 illustrated in the supersonic compression system 100 of FIG. 1 may be an axial-inlet, centrifugal compressor. The supersonic compressor 102 of the supersonic compression system 100 of FIG. 1 may be a single-stage compressor. Further, the supersonic compressor 102 may have a center-hung rotor configuration as illustrated in FIG. 1 or an overhung rotor configuration, as illustrated in FIG. 2.

Figure 2:
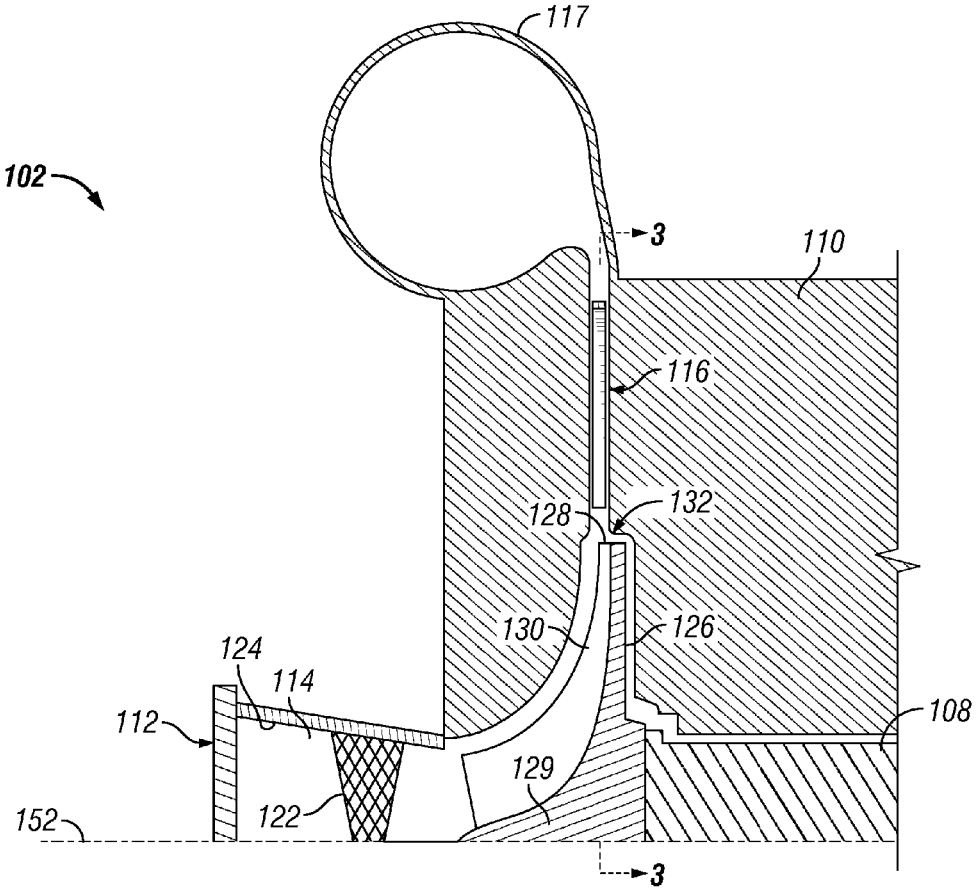
FIG. 2 illustrates a cross-sectional view of a portion of an exemplary supersonic compressor, which may be utilized in the supersonic compression system of FIG. 1, the supersonic compressor including an exemplary impeller and an exemplary static supersonic diffuser, according to one or more embodiments.

FIG. 2 illustrates a cross-sectional view of a portion of a supersonic compressor 102, which may be utilized in the supersonic compression system 100 of FIG. 1. As shown in FIG. 1 and more clearly in FIG. 2, the supersonic compressor 102 includes a housing 110 having an inlet 112 defining an inlet passageway 114, a static diffuser 116 fluidly coupled to the inlet passageway 114, and a collector 117 fluidly coupled to the static diffuser 116. The driver 104, or motor, may be disposed outside of (as shown in FIG. 1) or within the housing 110, such that the housing 110 may have a first end (not shown), or compressor end, and a second end (not shown), or motor end. The housing 110 may be configured to hermetically-seal the driver 104 and the supersonic compressor 102 within, thereby providing both support and protection to each component of the supersonic compression system 100.

The drive shaft 106 of the driver 104 and the rotary shaft 108 of the supersonic compressor 102 may be supported, respectively, by one or more radial bearings 118, as shown in FIG. 1. The radial bearings 118 may be directly or indirectly supported by the housing 110, and in turn provide support to the drive shaft 106 and the rotary shaft 108, which carry the supersonic compressor 102 and the driver 104 during operation of the supersonic compression system 100. In one embodiment, the radial bearings 118 may be magnetic bearings, such as active or passive magnetic bearings. In other embodiments, however, other types of bearings may be used. In addition, at least one axial thrust bearing 120 may be provided to manage movement of the rotary shaft 108 in the axial direction. In an embodiment in which the driver 104 and the supersonic compressor 102 are hermetically-sealed within the housing 110, the thrust bearing 120 may be provided at or near the end of the rotary shaft 108 adjacent the compressor end of the housing 110. The axial thrust bearing 120 may be a magnetic bearing and be configured to bear axial thrusts generated by the supersonic compressor 102.

As shown in FIG. 2, the inlet 112 defining the inlet passageway 114 of the supersonic compressor 102 may include one or more inlet guide vanes 122 configured to condition a process fluid flowing therethrough to include one or more predetermined parameters, such as a swirl, a velocity, a mass flow rate, a pressure, a temperature, and/or any suitable flow parameter to enable the supersonic compressor 102 to function as described herein. The inlet guide vanes 122 may be disposed within the inlet passageway 114 and may be static or moveable, i.e., adjustable. In an exemplary embodiment, a plurality of inlet guide vanes 122 may be arranged about a circumferential inner surface 124 of the inlet 112 in a spaced apart orientation. The spacing of the inlet guide vanes 122 may be equidistant or may vary depending on the predetermined parameter desired.

The supersonic compressor 102 may include a centrifugal impeller 126 configured to rotate within the housing 110. In an exemplary embodiment, the centrifugal impeller 126 includes a hub 129 and is open or "unshrouded." In another embodiment, the centrifugal impeller 126 may be semi-open or shrouded. The centrifugal impeller 126 may be operatively coupled to the rotary shaft 108 such that the rotary shaft 108, when acted upon by the driver 104 via the drive shaft 106, rotates, thereby causing the centrifugal impeller 126 to rotate such that process fluid flowing into the inlet 112 is drawn into the centrifugal impeller 126 and accelerated to a tip 128 of the centrifugal impeller 126, thereby increasing the velocity of the process fluid. In an embodiment, the velocity of the process fluid at the tip 128 of the centrifugal impeller 126 may be about Mach 1 or greater. In another embodiment, the velocity of the process fluid at the tip 128 of the centrifugal impeller 126 may be about Mach 2 or greater. In yet another embodiment, the velocity of the process fluid at the tip 128 of the centrifugal impeller 126 may have a velocity between about Mach 1.5 and about Mach 3.5, although wider ranges are certainly possible within the teachings hereof.

Figure 3:
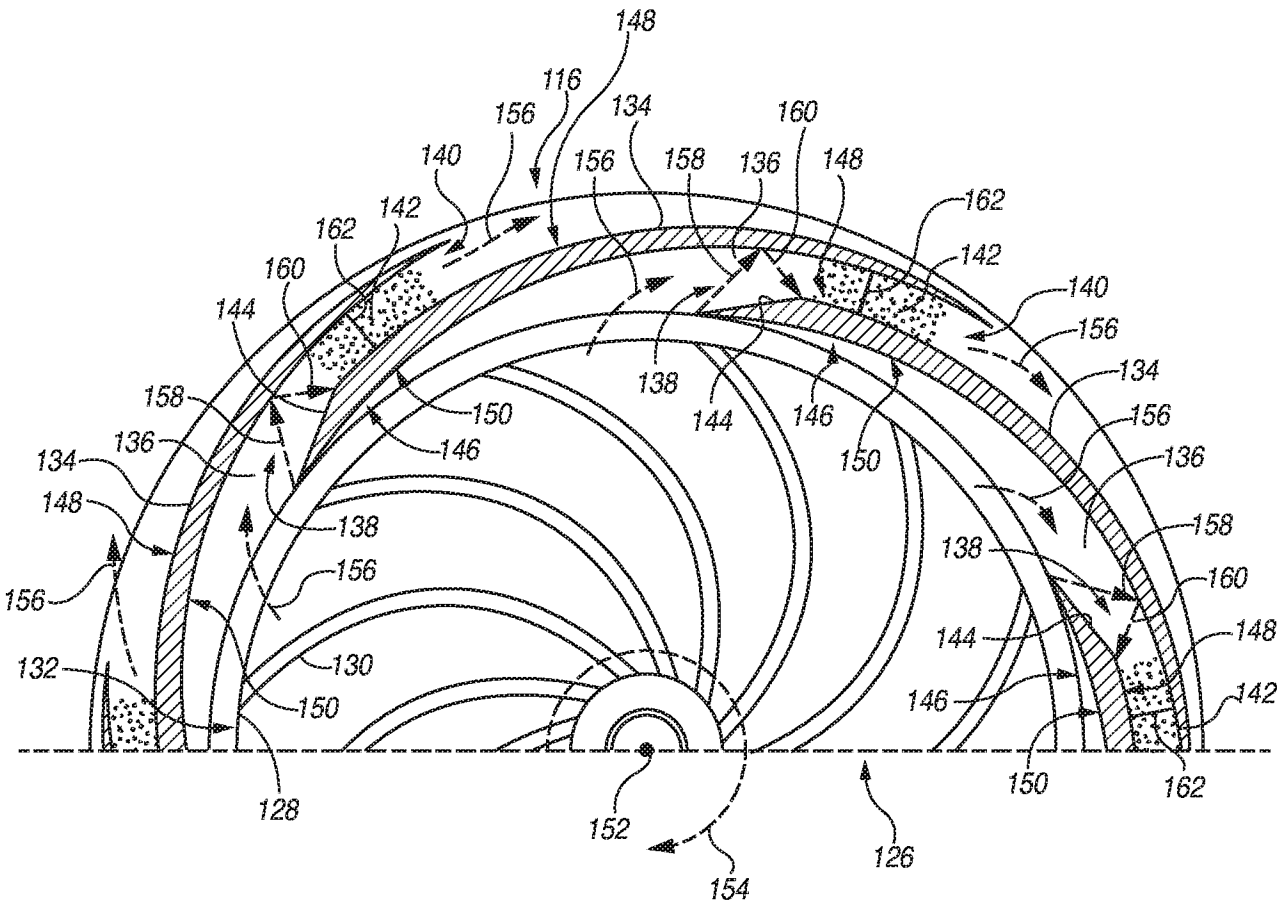
FIG. 3 illustrates a front view taken along line 3-3 of a portion of the impeller and static supersonic diffuser of FIG. 2.
Figure 5:
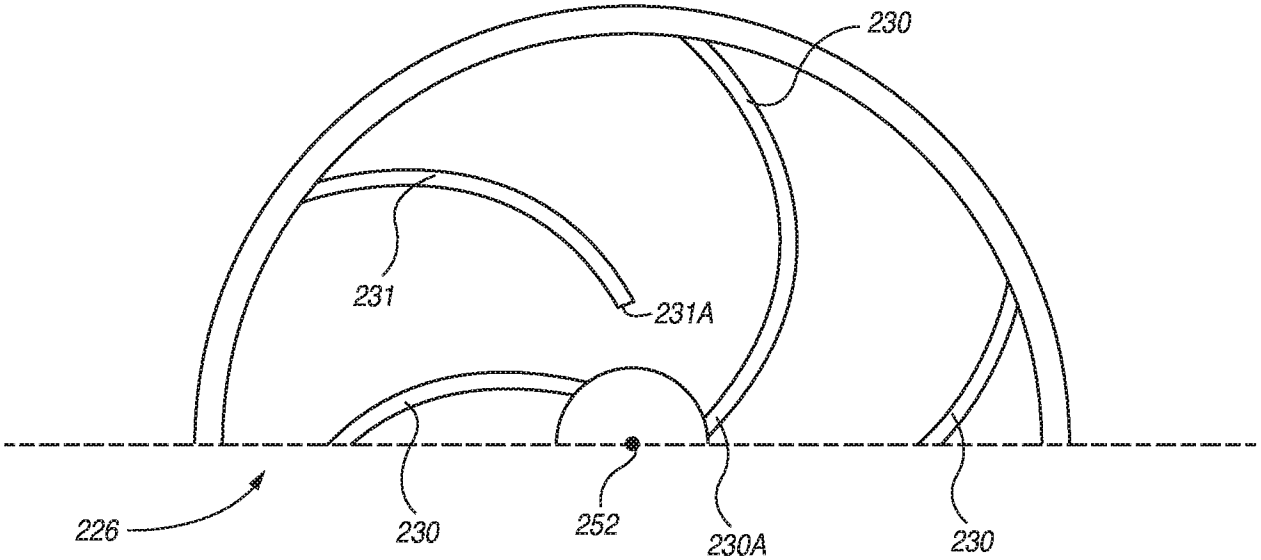
FIG. 5 is an alternate embodiment of the impeller of FIGS. 2 and 3.

FIG. 3 illustrates a front view taken along line 3-3 of a portion of the centrifugal impeller 126 and static diffuser 116 of FIG. 2. As shown in FIG. 3, the centrifugal impeller 126 may include a plurality of aerodynamic surfaces or blades 130 configured to increase the velocity and energy of the process fluid. Each blade of the plurality of blades may have a leading edge. In an exemplary embodiment of FIG. 5, the plurality of blades 230 may include one or more splitter blades 231 configured to reduce choking conditions that may occur in the supersonic compressor 102 depending on the number of blades 230 employed with respect to the centrifugal impeller 226. A splitter blade 231 may include a leading edge 231A that is not coplanar with at least one other leading edge 230A of the centrifugal impeller 226. Referring again to FIG. 3, the blades 130 of the centrifugal impeller 126 may be curved, such that the process fluid may be urged in a tangential and radial direction by the centrifugal force and may be discharged from the blade tips of the impeller (cumulatively, the tip 128 of the centrifugal impeller 126) in at least partially radial directions that extend 360 degrees around the centrifugal impeller 126.

The static diffuser 116 may be fluidly coupled to the inlet 112 and may be configured to receive the radial process fluid flow exiting the centrifugal impeller 126 as shown in FIG. 2. In an exemplary embodiment, the static diffuser 116 may be a vaned diffuser, such as a wedge diffuser having a plurality of diverging flowpaths. The static diffuser 116 may be configured to convert kinetic energy of the process fluid from the centrifugal impeller 126 into increased static pressure. In an exemplary embodiment, the static diffuser 116 may be located downstream of the centrifugal impeller 126 and may be statically disposed about the perimeter, or periphery 132, of the centrifugal impeller 126. The static diffuser 116 may be coupled with or integral with the housing 110 of the supersonic compressor 102. As shown most clearly in FIG. 3, the static diffuser 116 may include a plurality of diffuser vanes 134 arranged circumferentially about the periphery 132 of the centrifugal impeller 126. In an exemplary embodiment, the plurality of diffuser vanes 134 defines respective diffuser passageways 136 or radial flow channels, therebetween, such that each diffuser passageway 136 includes a diffuser passageway inlet 138, a diffuser passageway outlet 140, and a subsonic diffuser zone 142 therebetween. The diffuser passageways 136 are further configured to be in fluid communication with the radial flow of process fluid provided by the centrifugal impeller 126.

One or more of the plurality of diffuser vanes 134 may include a supersonic compression ramp 144 disposed at an end 146 of the respective diffuser vane 134 proximate the centrifugal impeller 126. In an exemplary embodiment, each of the diffuser vanes 134 includes a supersonic compression ramp 144 disposed at an end 146 of the respective diffuser vane 134 proximate the centrifugal impeller 126. Accordingly, each supersonic compression ramp 144 may terminate in a first sidewall, thereby forming the pressure surface 148. Correspondingly, an opposing sidewall of the diffuser vane 134 may be referred to as the suction surface 150. At least one of the supersonic compression ramps 144 may be integral with the respective diffuser vane 134; however, embodiments in which one or more of the supersonic compression ramps 144 are machined from different components or materials are contemplated herein.

FIG. 3 illustrates a static diffuser 116 including a plurality of diffuser vanes 134 having respective supersonic compression ramps 144 proximate the centrifugal impeller 126 in motion around an axis of rotation 152 (FIG. 2) defined by the rotary shaft 108 and drive shaft 106. In the embodiment illustrated in FIG. 3, as the centrifugal impeller 126 is rotated in the direction 154, the radial process fluid flow exiting the centrifugal impeller 126 enters each of the diffuser passageways 136 at the respective diffuser passageway inlet 138 and exits the diffuser passageway 136 via the respective diffuser passageway outlet 140. Directional arrows 156 indicate the direction of the process fluid flow through diffuser passageways 136 from the centrifugal impeller 126 to the collector 117. At very high tangential speeds, an oblique shock wave 158 may be set up within each diffuser passageway 136. The oblique shock wave 158 may be generated at the leading edge of the respective supersonic compression ramp 144 and is reflected by an adjacent diffuser vane 134 creating a reflective shock wave 160. Downstream of the supersonic compression ramp 144, the diffuser passageway area increases in the direction of the process fluid flow, and a normal shock wave 162 is set up in the diffuser passageway 136 followed by the subsonic diffusion zone 142.

Accordingly, the supersonic compressor 102 provided herein is said to be "supersonic" because the centrifugal impeller 126 may be designed to rotate about an axis of rotation 152 at high speeds such that a moving process fluid encountering the supersonic compression ramp 144 disposed within the diffuser passageway 136 is said to have a fluid velocity which is supersonic. Thus, in an exemplary embodiment, the moving process fluid encountering the supersonic compression ramp 144 may have a velocity in excess of Mach 1. However, to increase total energy of the fluid system, the moving process fluid encountering the supersonic compression ramp 144 may have a velocity in excess of Mach 2. More broadly, the velocity of the moving process fluid encountering the supersonic compression ramp 144 may have a velocity between about Mach 1.5 and about Mach 3.5, although wider ranges are certainly possible within the teachings hereof.

The process fluid flow leaving each diffuser passageway outlet 140 may flow into the collector 117, as most clearly seen in FIG. 2. The collector 117 may be configured to gather the process fluid flow from each of the diffuser passageways 136 and to deliver the process fluid flow to a downstream pipe and/or process component (not shown). In an exemplary embodiment, the collector 117 may be a discharge volute or specifically, a scroll-type discharge volute. In another embodiment, the collector 117 may be a plenum. The discharge volute 117 may be further configured to increase the static pressure of the process fluid flow by converting the kinetic energy of the process fluid to static pressure. The discharge volute 117 may have a round tongue (not shown). In another embodiment, the discharge volute may have a sharp tongue (not shown). It will be appreciated that the tongue of the discharge volute 117 may form other shapes known to those of ordinary skill in the art without varying from the scope of this disclosure.

One or more exemplary operational aspects of an exemplary supersonic compression system 100 will now be discussed with continued reference to FIGS. 1-3. A process fluid may be provided from an external source (not shown) having a low pressure environment to the supersonic compression system 100 including the supersonic compressor 102 having the centrifugal impeller 126 mounted about the rotary shaft 108 and the static diffuser 116 disposed about the rotating centrifugal impeller 126. The process fluid may be drawn into the inlet 112 of the supersonic compressor 102 with a velocity ranging, for example, from about Mach 0.05 to about Mach 0.40. The process fluid may flow through the inlet passageway 114 defined by the inlet 112 and across the inlet guide vanes 122 extending into the inlet passageway 114. The process fluid flowing across the inlet guide vanes 122 may be provided with an increased velocity and imparted with a swirl prior to be being drawn into the rotating centrifugal impeller 126. The inlet guide vanes 122 may be adjusted in order to vary the velocity and/or swirl imparted to the process fluid.

The process fluid may be drawn into the rotating centrifugal impeller 126 and may contact the curved centrifugal impeller blades 130, such that the process fluid may be accelerated in a tangential and radial direction by centrifugal force and may be discharged from the blade tips of the centrifugal impeller 126 (cumulatively, the tip 128 of the centrifugal impeller 126) in at least partially radial directions that extend 360 degrees around the rotating centrifugal impeller 126. The rotating centrifugal impeller 126 increases the velocity and pressure of the process fluid, such that the rotating centrifugal impeller 126 may provide a compression ratio of at least about 5:1. Moreover, the velocity of the process fluid discharged from the blade tips (tip 128) may be at least about Mach 1.

The static diffuser 116 may be disposed circumferentially about the perimeter, or periphery 132, of the centrifugal impeller 126 and may be coupled with or integral with the housing 110 of the supersonic compressor 102. The radial process fluid flow discharged from the rotating centrifugal impeller 126 may be received by the static diffuser 116, such that the velocity of the flow of process fluid discharged from the rotating centrifugal impeller 126 is substantially similar to the velocity of the process fluid entering the static diffuser 116. Accordingly, the process fluid may enter the static diffuser 116 with a velocity, for example, of at least Mach 1, and correspondingly, may be referred to as supersonic process fluid.

The supersonic process fluid flowing into the static diffuser 116 may contact a plurality of diffuser vanes 134 extending into the flowpath of the supersonic process fluid. In an exemplary embodiment, the plurality of diffuser vanes 134 are static (i.e., non-movable). In another embodiment, one or more of the diffuser vanes 134 may be adjustable. The static diffuser 116 further includes a plurality of diffuser passageways 136 defined by adjacent diffuser vanes 134 of the plurality of diffuser vanes 134, thereby providing a plurality of flowpaths, or flow channels, for the supersonic process fluid to flow therethrough. The diffuser passageways 136 may further include the diffuser passageway inlet 138, the diffuser passageway outlet 140, and the subsonic diffuser zone 142 therebetween. The diffuser vanes 134 may each have the pressure surface 148 and the opposing suction surface 150, such that the pressure surface 148 includes the supersonic compression ramp 144 provided at an end 146 of the respective diffuser vane 134 proximate the diffuser passageway inlet 138 and the centrifugal impeller tip 128.

The supersonic process fluid enters each of the diffuser passageways 136 at the respective diffuser passageway inlet 138 and exits each of the diffuser passageways 136 via the respective diffuser passageway outlet 140. The directional arrows 156 indicate the direction of process fluid low through diffuser passageways 136 from the centrifugal impeller 126 to the collector 117. An oblique shock wave 158 may be set up within each diffuser passageway 136. The oblique shock wave 158 may be generated at the leading edge of the respective supersonic compression ramp 144 and may be reflected by the adjacent diffuser vane 134 creating a reflective shock wave 160. Downstream of the supersonic compression ramp 144, the diffuser passageway area increases in the direction of the process fluid flow, and a normal shock wave 162 normal to flow direction may be set up in this diffuser passageway 136 followed by the subsonic diffusion zone 142. The static diffuser 116 may reduce the velocity and increase the pressure energy of the process fluid, such that the static diffuser 116 may provide a compression ratio of at least about 2:1.

The process fluid exiting the static diffuser 116 may have a subsonic velocity and may be fed into the collector 117 or discharge volute. The discharge volute 117 may increase the static pressure of the process fluid by converting the kinetic energy of the process fluid to static pressure. The process fluid may then be routed to perform work or for operation of one or more downstream processes or components (not shown).

In at least one embodiment, the process fluids pressurized, circulated, contained, or otherwise utilized in the supersonic compression system 100 may be in a fluid phase, a gas phase, a supercritical state, a subcritical state, or any combination thereof. In at least one embodiment, the supersonic compression system 100 may be utilized to compress various process fluids including high molecular weight process fluids, low molecular weight process fluids, or any mixtures or combinations thereof. High molecular weight process fluids may include those process fluids having a molecular weight of nitrogen ($N_2$) or greater. Illustrative high molecular weight process fluids may include, but are not limited to, hydrocarbons, such as ethane, propane, butane, pentane, and hexane. Other high molecular weight process fluids may include, but are not limited to, carbon dioxide ($CO_2$) or mixtures containing carbon dioxide. Low molecular weight process fluids may include those process fluids having a molecular weight equal to or greater than hydrogen ($H_2$) and less than nitrogen. Illustrative low molecular weight process fluids may include, but are not limited to hydrogen, methane, or mixtures containing hydrogen.

Utilizing carbon dioxide as the process fluid or as part of a mixture of the process fluid in the supersonic compression system 100 may provide one or more advantages over other compounds that may be utilized as the process fluid. For example, carbon dioxide may provide a readily available, inexpensive, non-toxic, and non-flammable process fluid. Due in part to a relatively high working pressure of carbon dioxide, the supersonic compression system 100 incorporating carbon dioxide, or mixtures containing carbon dioxide, may be more compact than other compression systems incorporating other process fluids. The high density and high heat capacity or volumetric heat capacity of carbon dioxide with respect to other process fluids may make carbon dioxide more "energy dense," meaning that a size of the supersonic compression system 100, and/or components thereof, may be reduced without reducing performance of the supersonic compression system 100. The carbon dioxide may be of any particular type, source, purity, or grade. For example, industrial grade carbon dioxide may be utilized as the process fluid without departing from the scope of the disclosure.

As previously discussed, the process fluids may be a mixture or process fluid mixture. The process fluid mixture may be selected for the desirable properties of the mixture within the supersonic compression system 100. For example, the process fluid mixture may include a liquid absorbent and carbon dioxide, or a mixture containing carbon dioxide, enabling the mixture to be compressed to a greater pressure with less energy input than required to compress carbon dioxide, or a mixture containing carbon dioxide, alone.

The supersonic compression system 100 including the supersonic compressor 102 may have a compression ratio of at least about 10:1 or greater. For example, the supersonic compression system 100 may compress the process fluid, thereby providing a pressure ratio from a low of about 10:1, about 10.1:1, about 10.2:1, about 10.3:1, about 10.4:1, about 10.5:1, about 10.6:1, about 10.7:1, about 10.8:1, about 10.9:1, or about 11:1 to a high of about 11.2:1, about 11.3:1, about 11.4:1, about 11.5:1, about 12:1, about 12.5:1, or greater.

Within the supersonic compression system 100, the rotating centrifugal impeller 126 may have a compression ratio of about 5:1 or greater. For example, the compression ratio of the rotating centrifugal impeller 126 may be from a low of about 5:1, about 5.1:1, about 5.2:1, about 5.3:1, about 5.4:1, about 5.5:1, or about 5.6:1 to a high of about 6:1, about 6.1:1, about 6.2:1, about 6.3:1, about 6.4:1, about 6.5:1, about 6.6:1, about 6.7:1, or greater. The static diffuser 116 may have a compression ratio of about 2:1 or greater. For example, the compression ratio of the static diffuser may be from a low of about 2:1, about 2.1:1, about 2.2:1, about 2.3:1, about 2.4:1, about 2.5:1, or about 2.6:1 to a high of about 3:1, about 3.1:1, about 3.2:1, about 3.3:1, about 3.4:1, about 3.5:1, about 3.6:1, about 3.7:1, or greater.

Figure 4:
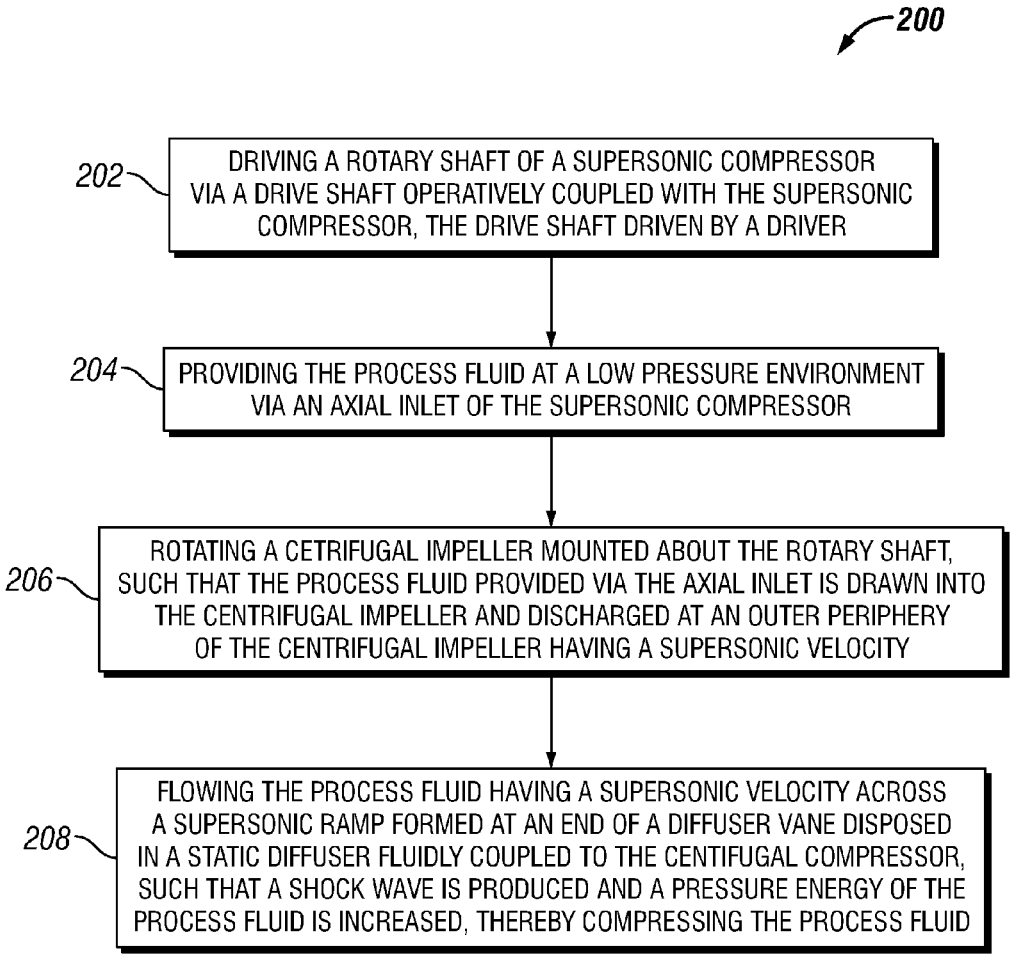
FIG. 4 is a flowchart depicting an exemplary method for compressing a process fluid, according to one or more embodiments.

FIG. 4 is a flowchart depicting an exemplary method 200 for compressing a process fluid according to one or more embodiments. The method 200 may include driving a rotary shaft of a supersonic compressor via a drive shaft operatively coupled with the supersonic compressor, as at 202. The supersonic compressor may provide a compression ratio of about 10:1 or greater, and the drive shaft may be driven by a driver, such as, for example, an electric motor.

The method 200 may also include providing the process fluid at a low pressure environment via an axial inlet of the supersonic compressor, as at 204. The axial inlet may include a plurality of inlet guide vanes extending into the inlet passageway and configured to condition the process fluid flowing therethrough to include one or more predetermined parameters comprising a swirl, a velocity, a mass flow rate, a pressure, and a temperature. In an exemplary embodiment, at least one of the plurality of inlet guide vanes is adjustable, and the method may also include adjusting at least one inlet guide vane of the plurality of inlet guide vanes to condition the process fluid to have the one or more predetermined parameters.

The method 200 may further include rotating a centrifugal impeller mounted about the rotary shaft, such that the process fluid provided via the axial inlet is drawn into the centrifugal impeller and discharged at a periphery of the centrifugal impeller having a supersonic velocity, as at 206. The method 200 may also include flowing the process fluid having a supersonic velocity across a supersonic ramp formed at an end of a diffuser vane disposed in a static diffuser fluidly coupled to the centrifugal compressor, such that at least one shock wave is produced and pressure energy of the process fluid is increased, thereby compressing the process fluid, as at 208.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. A supersonic compressor comprising:

an axial inlet defining an inlet passageway configured to receive and flow a process fluid therethrough;

a rotary shaft configured to be driven by a driver;

a centrifugal impeller mounted about the rotary shaft and fluidly coupled to the axial inlet, the centrifugal impeller having a periphery and configured to impart energy to the process fluid received via the axial inlet and discharge the process fluid, as discharged process fluid, from the periphery in at least a partially radial direction; and a static diffuser circumferentially disposed about the periphery of the centrifugal impeller and configured to receive the discharged process fluid from the centrifugal impeller and convert the energy imparted, the static diffuser having a plurality of curved diffuser vanes, each diffuser vane respectively defining curved, opposing pressure and suction sides, a leading edge proximate the periphery of the centrifugal impeller and conjoining the suction side, such that an adjacent diffuser vanes of the plurality of diffuser vanes defines a diffuser passageway configured to receive and flow therethrough the discharged process fluid with a velocity of at least Mach 1 and thus forming a flow of supersonic process fluid;

each of the diffuser vanes of the plurality of diffuser vanes having a structural arrangement including a supersonic compression ramp formed along its leading edge, the supersonic compression ramp diverging from the suction side and conjoining with the pressure side, a surface of the supersonic compression ramp arranged at the leading edge of the supersonic compression ramp to generate at the leading edge of the supersonic compression ramp in response to contact with the flow of supersonic process fluid an oblique shock wave, which is reflected by the adjacent diffuser vane of the plurality of diffuser vanes to form a reflective shock wave, a diffuser passageway arrangement downstream of the supersonic compression ramp where an area of the diffuser passageway increases in a direction of the flow of supersonic process fluid flow, and a normal shock wave is formed upstream of a subsonic diffusion zone in the diffuser passageway in response to flow of supersonic process fluid in the diffuser passageway arrangement, the normal shock wave being normal to the flow direction of the process fluid flow, the subsonic diffusion zone disposed between a diffuser passageway inlet and a diffuser passageway outlet, the structural arrangement including the supersonic compression ramp in each of the diffuser vanes of the plurality of diffuser vanes effective to increase the pressure energy of the discharge process fluid, and the diffuser passageway arrangement downstream of the supersonic compression ramp effective to reduce the velocity of the discharge process fluid exiting the static diffuser.

2. The supersonic compressor of claim 1, wherein the supersonic compressor further comprises a collector fluidly coupled to the diffuser and configured to collect the discharged process fluid flowing through at least one of the diffuser passageways.

3. The supersonic compressor of claim 2, wherein the collector is a discharge volute configured to be fluidly coupled to a downstream processing component.

4. The supersonic compressor of claim 1, wherein the axial inlet comprises a plurality of inlet guide vanes extending into the inlet passageway and configured to condition the process fluid flowing therethrough to include one or more predetermined parameters comprising a swirl, a velocity, a mass flow rate, a pressure, and a temperature.

5. The supersonic compressor of claim 4, wherein at least one of the plurality of inlet guide vanes is adjustable.

6. The supersonic compressor of claim 1, wherein the centrifugal impeller is configured to provide a compression ratio of at least about 5:1 and is further configured to rotate via the rotary shaft such that the process fluid flowing therethrough has a supersonic velocity at the periphery.

7. The supersonic compressor of claim 1, wherein the static diffuser is configured to provide a compression ratio of at least about 2:1, and the static diffuser is further configured to discharge the discharged process fluid flowing therethrough at a subsonic velocity.

8. The supersonic compressor of claim 1, wherein the diffuser passageway inlet is proximal the periphery of the centrifugal impeller and is fluidly coupled to the centrifugal impeller, and wherein the diffuser passageway outlet is disposed radially outward from the diffuser passageway inlet and fluidly coupled to a collector.

9. The supersonic compressor of claim 1, wherein the centrifugal impeller comprises a hub and a plurality of blades extending therefrom, each of the plurality of blades comprising a blade leading edge and at least one blade leading edge is not coplanar with at least one other blade leading edge.

10. A supersonic compression system comprising:

a driver comprising a drive shaft, the driver configured to provide the drive shaft with rotational energy;

a supersonic compressor operatively coupled to the driver via a rotary shaft integral with or coupled with the drive shaft, the supersonic compressor having:

an axial inlet defining an inlet passageway configured to flow a process fluid therethrough having a first velocity and first pressure energy;

a centrifugal impeller mounted about the rotary shaft and fluidly coupled to the axial inlet, the centrifugal impeller having a periphery and configured to increase the first velocity and first pressure energy of the process fluid received via the axial inlet and discharge the process fluid, as discharged process fluid, from the periphery in at least a partially radial direction having a second velocity and second pressure energy, the second velocity being a supersonic velocity and thus forming a flow of supersonic process fluid;

a static diffuser circumferentially disposed about the periphery of the centrifugal impeller and configured to receive and reduce the second velocity of the discharged process fluid to a third velocity and increase the pressure energy of the second pressure energy to a third pressure energy, the third velocity being a subsonic velocity and the static diffuser having a plurality of curved diffuser vanes, each diffuser vane respectively defining curved, opposing pressure and suction sides, a leading edge proximate the periphery of the centrifugal impeller and conjoining the suction side, such that an adjacent diffuser vanes of the plurality of diffuser vanes defines a diffuser passageway configured to receive and flow therethrough the flow of supersonic process fluid;

each of the diffuser vanes of the plurality of diffuser vanes having an structural arrangement including a supersonic compression ramp formed along its leading edge, the supersonic compression ramp diverging from the suction side and conjoining with the pressure side, a surface of the supersonic compression ramp arranged at the leading edge of the supersonic compression ramp to generate at the leading edge of the supersonic compression ramp in response to contact with the flow of supersonic process fluid an oblique shock wave, which is reflected by the adjacent diffuser vane of the plurality of diffuser vanes to form a reflective shock wave, a diffuser passageway arrangement downstream of the supersonic compression ramp where an area of the diffuser passageway increases in a direction of the flow of supersonic process fluid flow, and a normal shock wave is formed in the diffuser passageway upstream of a subsonic diffusion zone in the diffuser passageway in response to flow of supersonic process fluid in the diffuser passageway arrangement, the normal shock wave normal to the flow direction of the process fluid flow, the subsonic diffusion zone disposed between a diffuser passageway inlet and a diffuser passageway outlet, wherein the structural arrangement including the supersonic compression ramp in each of the diffuser vanes of the plurality of diffuser vanes is effective to increase the pressure energy of the discharge process fluid, and the diffuser passageway arrangement downstream of the supersonic compression ramp is effective to reduce the velocity of the discharge process fluid exiting the static diffuser; and a discharge volute fluidly coupled to the static diffuser and configured to receive the process fluid flowing therefrom with the increase the pressure energy and the reduced velocity.

11. The supersonic compression system of claim 10, wherein the axial inlet comprises a plurality of inlet guide vanes extending into the inlet passageway and configured to condition the process fluid flowing therethrough to include one or more predetermined parameters comprising a swirl, the first velocity, a mass flow rate, a pressure, and a temperature.

12. The supersonic compression system of claim 11, wherein at least one of the plurality of inlet guide vanes is adjustable.

13. The supersonic compression system of claim 10, wherein the centrifugal impeller is configured to provide a compression ratio of at least about 5:1 and the static diffuser is configured to provide a compression ratio of at least about 2:1.

14. The supersonic compression system of claim 10, wherein the process fluid is a high molecular weight process fluid and the supersonic compressor is configured to provide a compression ratio of about 10:1 or greater.

15. A method for compressing a process fluid, comprising:

providing a supersonic compressor, including:

an axial inlet defining an inlet passageway configured to receive and flow a process fluid therethrough;

a rotary shaft configured to be driven by a driver;

a centrifugal impeller mounted about the rotary shaft and fluidly coupled to the axial inlet, the centrifugal impeller having a periphery and configured to impart energy to the process fluid received via the axial inlet and discharge the process fluid, as discharged process fluid, from the periphery in at least a partially radial direction; and a static diffuser circumferentially disposed about the periphery of the centrifugal impeller and configured to receive the discharged process fluid from the centrifugal impeller and convert the energy imparted, the static diffuser having a plurality of curved diffuser vanes, each diffuser vane respectively defining curved, opposing pressure and suction sides, a leading edge proximate the periphery of the centrifugal impeller and conjoining the suction side, such that an adjacent diffuser vane of the plurality of diffuser vanes defines a diffuser passageway configured to receive and flow therethrough the discharged process fluid with a velocity of at least Mach 1 and thus forming a flow of supersonic process fluid;

each of the diffuser vanes of the plurality of diffuser vanes having a structural arrangement including a supersonic compression ramp formed along its leading edge, the supersonic compression ramp diverging from the suction side and conjoining with the pressure side;

driving the rotary shaft via a drive shaft driven by the driver;

providing the process fluid at a low pressure environment via the axial inlet of the supersonic compressor;

rotating the centrifugal impeller mounted about the rotary shaft, such that the process fluid provided via the axial inlet is drawn into the centrifugal impeller and discharged at the periphery of the centrifugal impeller, as discharged process fluid, at supersonic velocity;

flowing the discharged process fluid, discharged at supersonic velocity and thus forming a flow of supersonic process fluid across the supersonic compression ramp formed at the leading edge of each of the diffuser vanes of the plurality of diffuser vanes;

arranging a surface of the supersonic compression ramp at the leading edge of the supersonic compression ramp to generate in response to contact with the flow of supersonic process fluid an oblique shock wave, which is reflected by the adjacent diffuser vane of the plurality of diffuser vanes to form a reflective shock wave; and arranging the diffuser passageway downstream of the supersonic compression ramp so that an area of the diffuser passageway increases in a direction of the flow of supersonic process fluid flow, and a normal shock wave is formed in the diffuser passageway upstream of a subsonic diffusion zone in the diffuser passageway in response to flow of supersonic process fluid in the diffuser passageway downstream of the supersonic compression ramp, the normal shock wave normal to the flow direction of the process fluid flow, the subsonic diffusion zone disposed between a diffuser passageway inlet and a diffuser passageway outlet, the structural arrangement including the supersonic compression ramp in each of the diffuser vanes of the plurality of diffuser vanes effective to increase the pressure energy of the discharge process fluid, and the arranging of the diffuser passageway downstream of the supersonic compression ramp effective to reduce the velocity of the discharge process fluid exiting the static diffuser.

16. The method of claim 15, wherein the supersonic compressor is configured to provide a compression ratio of about 10:1 or greater.

17. The method of claim 15, wherein the axial inlet comprises a plurality of inlet guide vanes extending into the inlet passageway and configured to condition the process fluid flowing therethrough to include one or more predetermined parameters comprising a swirl, an inlet velocity, a mass flow rate, a pressure, and a temperature.

18. The method of claim 17, further comprising adjusting at least one inlet guide vane of the plurality of inlet guide vanes to condition the process fluid to have the one or more predetermined parameters.

* * * * *